United States Patent [19]

Fildan

[11] 4,204,300

[45] May 27, 1980

[54] FASTENER FOR GARMENTS

[76] Inventor: Gerhard Fildan, Kriehubergasse 31, A-1050 Wien, Österreich, Austria

[21] Appl. No.: 928,450

[22] Filed: Jul. 27, 1978

[30] Foreign Application Priority Data

Jul. 28, 1977 [AT] Austria ..... 5526/77

[51] Int. Cl.[2] ..... A44B 17/00

[52] U.S. Cl. ..... 24/201 HE

[58] Field of Search ..... 24/201 HE, 201 HH

[56] References Cited

U.S. PATENT DOCUMENTS

| | | | |
|---|---|---|---|
| 378,874 | 3/1888 | Davis | 24/201 HH |
| 1,387,135 | 8/1921 | Farnham | 24/226 |
| 2,592,148 | 4/1952 | Isaacs | 24/201 HE |
| 3,426,400 | 2/1969 | Lauro . | |
| 3,445,901 | 5/1969 | Kamper | 24/201 HE |
| 3,484,907 | 12/1969 | Elsenheimer | 24/206 R |
| 3,535,753 | 10/1970 | Kruger | 24/226 |
| 3,892,015 | 7/1975 | Taylor | 24/225 |

FOREIGN PATENT DOCUMENTS

| | | |
|---|---|---|
| 314444 | 4/1974 | Austria . |
| 1260217 | 2/1968 | Fed. Rep. of Germany . |
| 56748 | 7/1967 | German Democratic Rep. . |
| 70045 | 12/1969 | German Democratic Rep. . |
| 95818 | 2/1973 | German Democratic Rep. . |
| 1125255 | 8/1968 | United Kingdom . |

*Primary Examiner*—Philip C. Kannan

*Attorney, Agent, or Firm*—Fleit & Jacobson

[57] ABSTRACT

A hook fastener of plastic material for garments, particularly brassieres, consists of two fastener members, one of which is provided with an eyelet and the other with a lug which can be engaged with the eyelet. The fastener members consist of plates (1, 2). The eyelet consists of an arch over an aperture which has the configuration of a projection of the arch. The lug faces the fixing end of the plate provided with the lug and is disposed adjacent to an aperture thereof.

9 Claims, 9 Drawing Figures

FASTENER FOR GARMENTS

SUMMARY OF THE INVENTION

Figure 1:
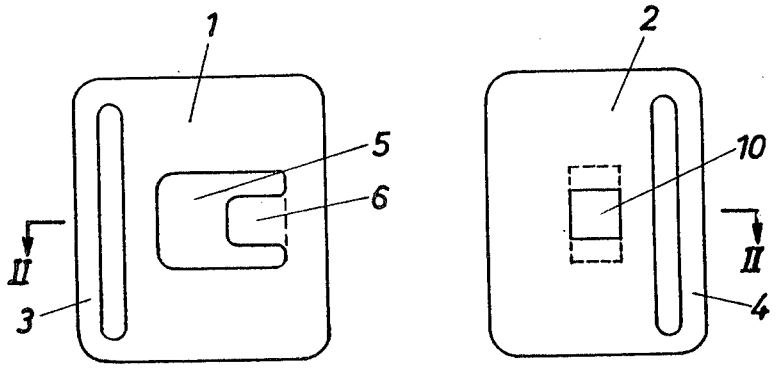

A hook fastener for garments consists of two plates, one of which has an arch, which bridges an aperture, and the other has at least one lug, which is fixed at one end and adapted to be slidably inserted under the arch in the direction in which tension is to be applied.

This invention relates to a fastener for garments, particularly for use as a hook fastener at the rear of a brassiere.

Hook fasteners for brassieres have previously been made from metal and for this reason had the disadvantage that they damaged garments when these were being washed, particularly in a washing machine. It was also difficult to make and secure such hooks.

It is an object of the invention to propose measures which enable the fastener to be made from plastic material. According to a feature of the invention, two plates are provided, one of which comprises an arch, which bridges an aperture, whereas the other plate comprises at least one lug, which is fixed at one end and adapted to be inserted under the arch in the direction in which tension is to be applied to the fastener. Such fastener is flat and does not apply local pressure to the body of the wearer.

Further details will be explained more fully with reference to the drawing, which shows illustrative embodiments of the fastener according to the invention.

Figure 2:
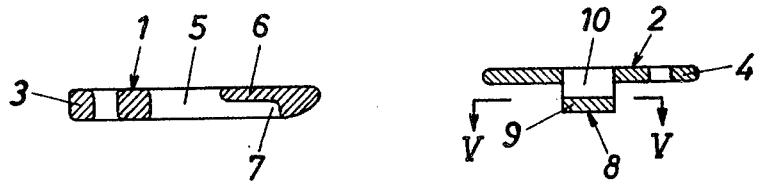
Figure 3:
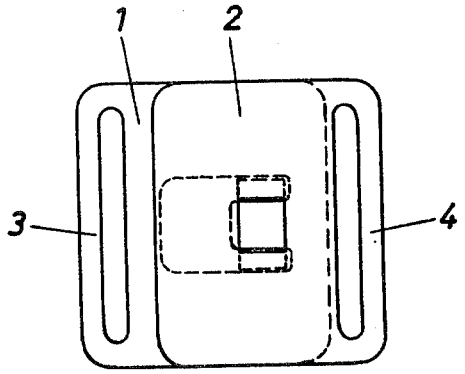
Figure 4:
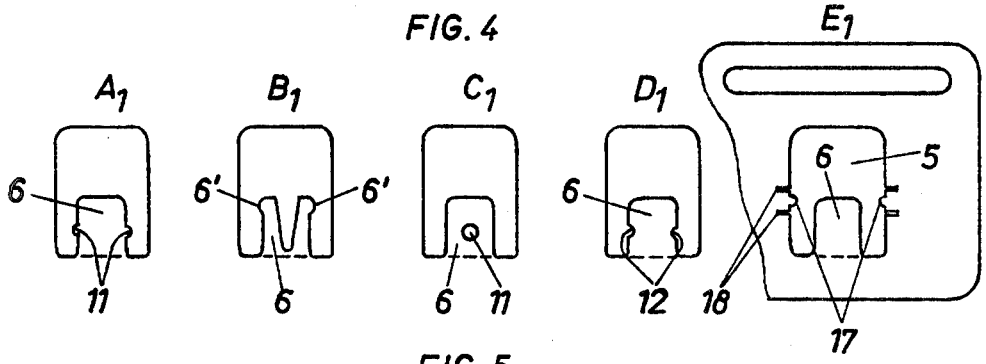
Figure 5:
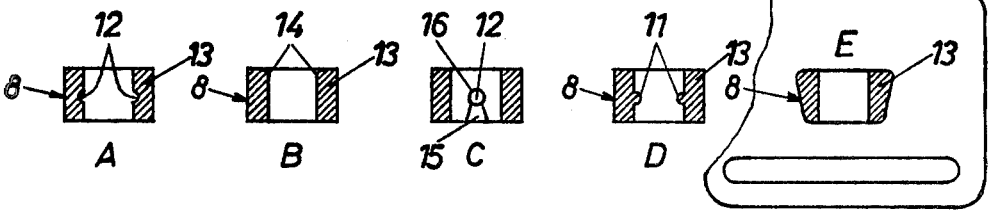
Figure 6:
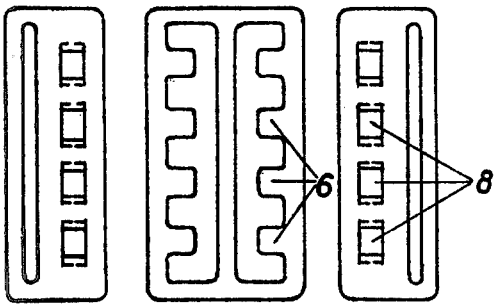
Figure 9:
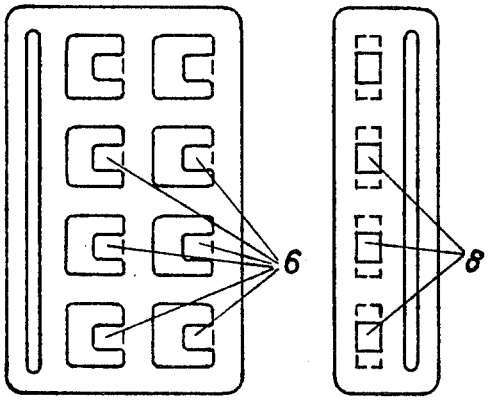
Figure 7:
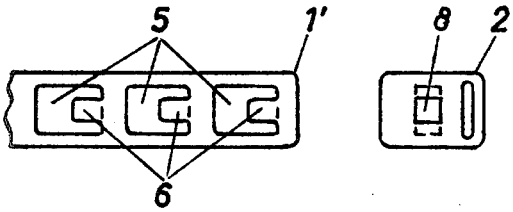
Figure 8:
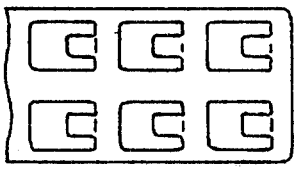

FIG. 1 is a top plan view showing the fastener in an open state,

FIG. 2 a sectional view taken on line II—II in FIG. 1,

FIG. 3 a top plan view showing the fastener in a closed state,

FIG. 4 a top plan view showing various embodiments of the hook member,

FIG. 5 a sectional view taken on line V—V in FIG. 2 and showing several embodiments of the eyelet member corresponding to the hook members shown in FIG. 4, FIG. 6 a view showing an embodiment of the fastener for a brassiere for nursing mothers, and FIG. 7 a view showing another fastener provided with adjusting means and FIGS. 8 and 9 show a two-row and a four-row embodiment of the fastener of FIG. 7.

In its simplest form, shown in FIGS. 1 to 3, the fastener consists of two plates 1, 2, which at those ends that are remote from each other in the fastening direction are provided each with a fixing portion 3 or 4, which is to be sewn to a garment. In the present case the fixing portions 3 and 4 consist of eyelets through which a ribbon, e.g., can be pulled. The portions to be sewn to a garment may also consist of a thin plate of plastic material which can be pierced by a sewing needle. Alternatively, the fastener members may be injection-molded on ribbons or the like. The plate 1 has a substantially rectangular aperture 5, which has rounded corners. In addition, the plate 5 has a lug 6, which centrally symmetrically protrudes outwardly from that/side of the aperture 5 which is remote from the fixing portion 3 and extends approximately as far as to the middle of the length of the aperture. The thickness of the lug 6 is about one-half the thickness of the plate 1. The end of the lug is flush with the front end face of the plate 1.

The lug forms a step 7 on its rear side, which faces the wearer's skin when the fastener is used in a brassiere.

The second plate 2 has a substantially channel-shaped arch 8, which registers with the lug 6, and under the cross-piece 9 of said arch has an aperture 10, which corresponds to the projection of said crosspiece. That plate just as the plate 1 described hereinbefore can be made from plastic material by means of a two-part mold without need for a core.

The fastener is used like a hook strap. When the plate 1 has been placed over the plate 2 and the lug 6 has been moved to a position in front of the arch 8 in the direction in which tension is to be applied, the lug 6 is also slightly bent outwardly and caused to snap in under the arch 8. To prevent an unintended separation of the two fastener members, a detent mechanism may be provided between the lug 6 and the arch. In the embodiment A, $A_1$ shown in FIGS. 4 and 5, the lug 6 is provided for this purpose with laterally protruding bosses 11, which snap into mating recesses 12 of the limbs 13 of the arch 8.

In the embodiment B, $B_1$, the lug 6 is centrally slit and expanded so that its bulged-out end portions 6' snap like barbs behind a rounded edge portion 14 of the limbs 13 of the arch 8.

The embodiment C, $C_1$ comprises a boss 11 on that surface of the lug which faces the crosspiece of the arch 9, and in the opposite surface of the crosspiece of the arch 9 a corresponding depression 12 and a recess 15, which extends into the depression and tapers in wedge shape from the outer edge of the crosspiece 9 to the depression. The width of the mouth 16 of the recess 15 is smaller than the diameter of the boss 11 so that the boss and the boundary surface of the mouth 16 are elastically deformed when the boss 11 has been moved in the recess and snaps into the depression.

The embodiment D, $D_1$ is virtually an inversion of the embodiment A, $A_1$. The bosses 11 are provided on the inside surfaces of the limbs 13 of the arch 8, and the depressions 12 are formed in the side faces of the lug 6.

When the fastener members of the embodiment E, $E_1$ are in their closed position, the outside surfaces of the limbs 13 of the arch 8 taper toward the root of the lug 6 and those boundary surfaces of the aperture 5 which face in the direction in which tension is to be applied are provided with inwardly protruding projections 17, which snap behind the arch 8 when the lug 6 has been inserted under the arch 8. Small slits 18 on opposite sides of the projections 17 improve the resiliency of the projections 17.

The fastener shown in FIG. 6 comprises a plurality of lugs 6, which are disposed in a row that is transverse to the direction in which tension is to be applied. The lugs 6 can simultaneously enter arches 8 arranged in a corresponding row.

In the embodiment shown in FIG. 7 the plate 1 mentioned first has been shaped to form a strap 1', which has a plurality of apertures 5, which are arranged in a row and provided with respective lugs 6. Depending on the desired length of the fastener, each of the lugs 6 can be engaged with a mating arch 8 of the other plate 2.

The embodiment shown in FIG. 8 is similar to that of FIG. 7 and comprises a plurality of arches, which can be selectively engaged with one lug or with a plurality of lugs arranged in a row.

The embodiment shown in FIG. 9 is a combination of the embodiments shown in FIGS. 6 and 7. A plurality of rows of lugs 6, in the present case two of such rows, can be engaged with a row of arches 8.

It will be understood that in this case an arrangement similar to that described in connection with FIG. 7 may be adopted.

The fastener can be used wherever eye straps and hook straps have been used before. The embodiments of the fastener shown in FIGS. 6 and 9 may also be used for sports garments, e.g., as a lateral fastener for ladies' tennis shorts.

An important feature of the invention resides in that the arch 8 occupies the entire width of the aperture 5 and thus exactly guides the lug 6 as it moves into the arch 8.

It is also possible to injection-mold a plurality of spaced apart plates of one type or the other on a ribbon of any desired length so that the ribbon extends through the plate in the longitudinal center plane. In that case the lug 6 has suitably the same thickness as the plate so that there is no step, and the arch 8 must protrude over the plate 2 approximately to the extent of the thickness of the lug 6.

Alternatively, a step may be provided on both sides of the lug 6.

As is apparent, e.g., from FIGS. 6, 8, and 9, in a fastener having a plurality of lugs 6 the lugs arranged in a row may differ in width. The embodiment shown in FIG. 6 comprises two juxtaposed rows of lugs. The lugs of each row can be hooked into a row of arches, which may be fixed to each cup. The plate provided with the lugs 6 lies between the rows of arches so that one cup or the other or both cups may be removed from the breasts. FIG. 9 shows a simplified arrangement comprising a plate provided with a row of arches 8 disposed only on one side of the lugs 6.

What is claimed is:

1. A hook fastener for garments comprising:

a first substantially platelike member having an arched bridge protruding from a surface of the member, a first aperture formed in the first member in alignment with the protruding portion of the bridge, and a portion of the first member having a predetermined shape for fixing the first member to a garment, the bridge cooperating with the surface of the first member to define an opening extending in a direction in which tension is applied to the fastener; and a second substantially platelike member having a portion thereof shaped to define a fixing portion for fixing the second member to a garment, and a second aperture formed in the second member with side walls spaced from the fixing portion, the second aperture having a first portion thereof closest to the fixing portion shaped to provide a sufficiently large opening for insertion of said bridge into said second aperture, a second portion of the second aperture being partially blocked by a lug protruding towards the fixing portion from a portion of a side wall of the aperture, the protruding portion being spaced from adjacent side walls so that the lug is insertable into the opening defined by the bridge.

2. A hook fastener for garments, comprising two substantially flat platelike members of plastic material, a first of said members having at least one arched bridge which protrudes from a surface of said member, a fixing portion, and at least one aperture which has a contour that includes the projection of said at least one bridge onto said surface, a second of said members having a fixing portion, at least one aperture, and at least one lug, said at least one bridge forming an opening which extends in the direction in which tension is to be applied to the fastener for receiving said at least one lug, said at least one aperture in said second member having substantially the configuration of a rectangle with two edges extending in the direction in which tension is to be applied to said hook fastener and two transverse edges extending transversely to said direction, a first of said transverse edes being remote from said fixing portion of said second member and the other of said transverse edges being close to said fixing portion, said at least one lug extending from said first transverse edge into said at least one aperture in said second member, and having an end spaced from said other transverse edge by a predetermined distance sufficiently large to allow insertion of said bridge into said at least one aperture in said second member.

3. A hook fastener as set forth in claim 2, characterized in that said edges extending in the direction in which tension is to be applied have elevations which present a resistance to and are adapted to yield to said at least one bridge as it is moved past said elevations, said elevations comprising detent means which snap behind said at least one bridge as said fastener reaches a closed position.

4. A hook fastener as set forth in claim 2, characterized in that the first member comprises a plurality of bridges which are spaced apart in the direction in which tension is to be applied to the fastener, and an aperture under each of said bridges, so that said lug of said second member can be inserted under each of the bridges to thereby adjust the desired length of the fastener.

5. A hook fastener as set forth in claim 2, further comprising at least two first members and characterized in that the second member has at least two juxtaposed lugs, one of which is engageable with the at least one bridge of a first of said two first members and the other of which is engageable with the at least one bridge of the other of said first members.

6. A hook fastener as set forth in claim 2, characterized in that the thickness of the at least one lug is about one-half the thickness of the second member and the at least one lug has a surface flush with one surface of said second member.

7. A hook fastener as set forth in claim 2, characterized in that the at least one lug and the at least one bridge have elevations and depressions which are adapted to snap into each other.

8. A hook fastener according to claim 2, characterized in that the second member has a row of spaced apart lugs.

9. A hook fastener according to claim 8, characterized in that the second member includes a plurality of apertures so that each lug protrudes into a separate aperture, which is substantially rectangular.

* * * * *